US005143387A

United States Patent [19]

Colla

[11] Patent Number: 5,143,387

[45] Date of Patent: Sep. 1, 1992

[54] ROLLER SKATE BRAKE ASSEMBLY HAVING TOE ACTUATOR WITHIN THE BOOT

[75] Inventor: Jeff M. Colla, 8729 Bentwood Dr., Eden Prairie, Minn. 55344

[73] Assignee: Jeff M. Colla, Eden Prairie, Minn.

[21] Appl. No.: 754,020

[22] Filed: Sep. 3, 1991

[51] Int. Cl.[5] ..... A63C 17/14; A63C 17/06

[52] U.S. Cl. ..... 280/11.2; 280/11.22; 36/1; 188/74

[58] Field of Search ..... 280/11.2, 11.21, 11.22, 280/11.23, 11.27, 87.041, 87.042; 36/1, 137, 139; 188/29, 74

[56] References Cited

U.S. PATENT DOCUMENTS

| | | | |
|---|---|---|---|
| 906,281 | 12/1908 | Plimpton | 280/11.2 X |
| 1,517,352 | 12/1924 | Foote | 280/11.21 X |
| 3,000,643 | 9/1961 | Levin | 280/11.2 |
| 3,008,038 | 11/1961 | Dickens et al. | 36/137 X |
| 3,385,608 | 5/1968 | Waddell | 280/11.2 |
| 3,900,203 | 8/1975 | Kukulowicz | 280/11.2 |
| 3,945,655 | 3/1976 | Banks et al. | 280/11.2 |
| 4,027,890 | 6/1977 | Volkmann | 280/11.2 |
| 4,055,234 | 10/1977 | Burton | 280/87.042 X |
| 4,061,348 | 12/1977 | Carter | 280/11.21 |
| 4,084,831 | 4/1978 | Akonteh et al. | 280/11.2 |
| 4,275,895 | 6/1981 | Edwards | 280/11.2 |
| 4,418,929 | 12/1983 | Gray | 280/11.23 |
| 4,909,523 | 5/1990 | Olson | 280/11.2 |
| 4,911,456 | 3/1990 | Sarazen | 280/11.2 |

FOREIGN PATENT DOCUMENTS

| | | | |
|---|---|---|---|
| 35107 | 4/1912 | Sweden | 280/11.2 |

*Primary Examiner*—Andres Kashnikow
*Assistant Examiner*—Brian L. Johnson

[57] ABSTRACT

An improved and safer roller skate having a braking assembly operable against the wheels, engaged when a user's toes are curled in the skate boot, moving a toe actuator attached to an external slide bar assembly, that slides toward the heel with attached brake pads which in turn engage with the wheels. A resilient compressible member normally holds the brake pads away from the wheels in a nonbraking position.

11 Claims, 3 Drawing Sheets

ROLLER SKATE BRAKE ASSEMBLY HAVING TOE ACTUATOR WITHIN THE BOOT

BACKGROUND—FIELD OF INVENTION

This invention relates to new and useful control and stopping improvements in roller skates.

BACKGROUND—DESCRIPTION OF PRIOR ART

Heretofore, roller skates and in particular in-line roller skates, have achieved improved performance and speed and have been the growing cause of many severe injuries due to difficulties in stopping safely. The current braking system involves a rubber brake pad that is mounted at an angle on the heel or toe and dragged across the skating surface to slow down. The act of dragging the brake involves tipping one of the skates in the air in order to engage the surface of the heel brake and the skating surface. This braking system has not kept pace with improved skate performance and the enormous popularity the sport is achieving, forcing many novice skaters into dangerous safety situations. This braking system requires agile balance skills while tipping the skate to stop while in motion, and is perilously dependent upon the variability of skating surfaces for effectiveness (i.e. gravel, pavement, grass, etc.). The result is increasing incidents of broken wrists, arms and legs along with numerous scrapes and bruises. This particular brake is detailed in U.S. Pat. No. 4,909,523 to Olson, on Mar. 20, 1990.

The brake in U.S. Pat. No. 4,027,890 to Volkmann, on Jun. 7, 1997, had limited braking ability based upon small frictional surface areas, possible accidental brake application, non-adjustability and the tendency to "lock" the wheels during hard application. I have found through experimentation that braking systems that use force vectors downward towards the wheels have a high incidence of accidental application during routine acceleration since the foot normally "pushes off" the sole of the skate. Additionally force vectors in this direction can more easily "lock" the wheels, causing unsafe stopping.

The braking mechanism in U.S. Pat. No. 3,900,203 to Kukulowicz, on Aug. 19, 1975, provides braking action by a stooping action and the adjusting of the head of a tightening nut while skating. This is of impractical application when skating and in itself could lead to some rather dangerous situations. The idea of tightening two nuts to achieve equal front and back brake balance is very difficult to apply during recreational skating.

All the braking mechanisms heretofore known suffer from a number of disadvantages:

(a) Their application requires skillful balancing and shifting of weight usually in a critical few seconds before possible injuries result. This skill cannot be taught but is learned through painful experience and results in many people abandoning the sport or fearfully slowing down and thereby not achieving the full enjoyment of roller skating.

(b) An unpredictable dependence on the frictional forces between the brake material and the dragging surface. Since the skater cannot anticipate the proper force application for controlled stopping, between a variety of surfaces such as pavement and gravel, he cannot stop under control and frequently has dangerous falls.

(c) The brakes themselves are not ergonomically designed for a comfortable fit and do not offer adjustability for personal preferences as well as replaceability.

(d) The brakes are inconvenient, necessitating stooping and using hands to apply the brakes.

(e) Brakes that can be easily engaged in both skates and offer variable slowdown features for hills and the ability to speed turn via individual brake application.

(f) Brake assemblies that extend outside the skate boot and wheel housing detracting from the visual aesthetics of sleek skate design.

SUMMARY, OBJECTS AND ADVANTAGES

Accordingly, several objects and advantages of my invention are:

(a) to provide a superior braking system that can easily, knowingly, and safely be applied, without the need for high levels of skill, balance and agility.

(b) to provide a braking system that slows and stops a skater under control regardless of the type of surfaces being skated upon.

(c) to provide a braking system that is ergonomically integrated into the roller skate without affecting normal skating or aesthetics.

(d) to provide a braking system that is adaptable and retrofitable to current skate designs.

(e) to provide a braking system that can be applied to both roller skates and afford controlled slowdown on hills or rough surfaces. Additionally, selective turning can be achieved by individual brake application while in motion. This could open the doors for a whole new sport, such as figure skating without ice.

(f) to provide complete brake position adjustability for personal skating and braking preferences, as well as maintain easy wheel and brake pad replaceability.

Further objects and advantages of m invention will become apparent from a consideration of the drawings and ensuing description of it.

BRIEF DESCRIPTION OF THE DRAWING FIGURES

FIG. 1 is a side view of an in-line roller skate with an embodiment of the brake assembly when not engaged; and FIG. 2 is a side view of an in-line roller skate with an embodiment of the brake assembly when engaged; and FIG. 3 is an exploded view of the brake assembly showing the slide bar guides which were removed in FIGS. 1 & 2 for clarity.

Reference Numerals In Drawings

| | | | |
|---|---|---|---|
| 8 | skate boot | 24 | slide bar mount |
| 10 | toe actuator | 26 | slide bar nut |
| 12 | slide bar | 28 | coil spring |
| 14 | toe actuator nut | 30 | slotted sole for actuator |
| 16 | brake pad | 32 | foot |
| 18 | wheel | 34 | screws |
| 20 | wheel holding frame | 36L | left slide bar guide |
| 22 | wheel nut | 36R | right slide bar guide |

DETAILED DESCRIPTION OF THE INVENTION

Figure 1:
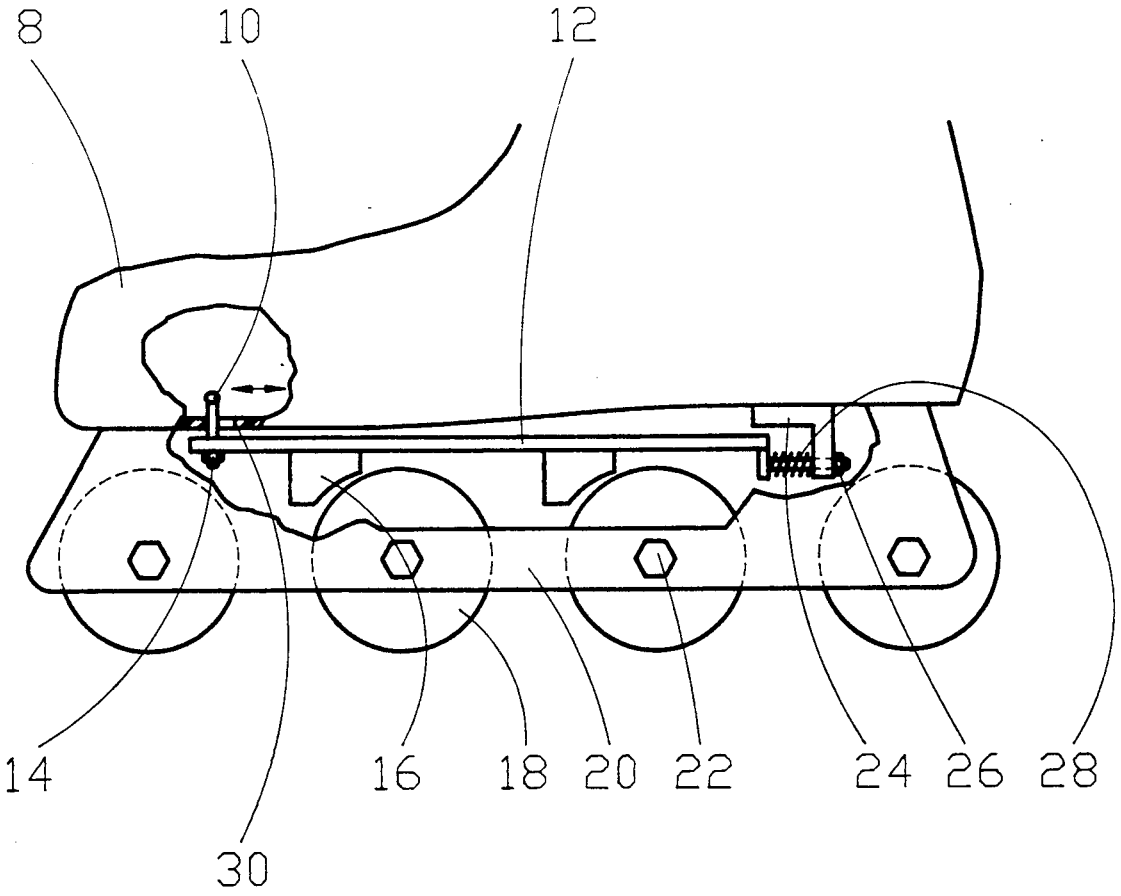
Figure 2:
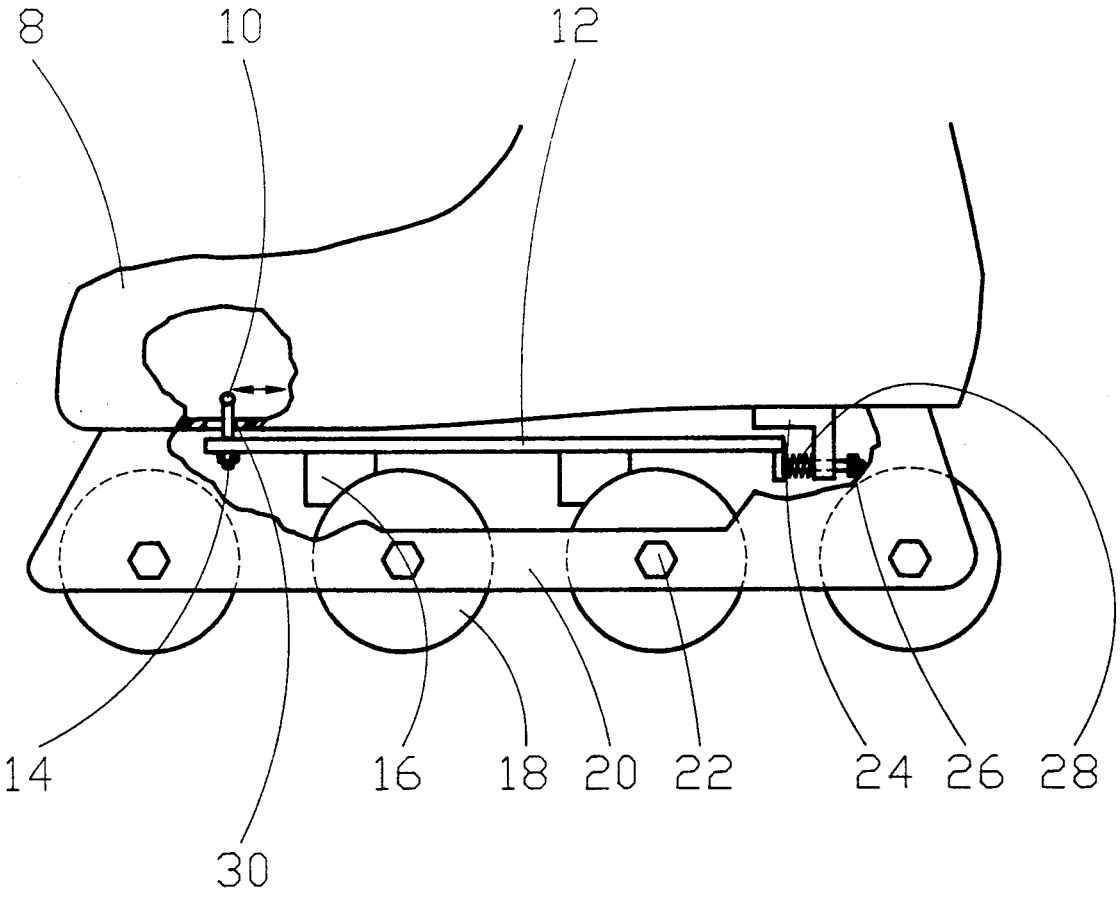

A typical embodiment of the present invention is illustrated in FIG. 1 (side view—brake not engaged) and FIG. 2 (side view brake engaged). The braking assembly is integrated into and under the foot support platform of the in-line roller skate which consists of a tandem-wheeled roller skate wherein the wheels are arranged in a single file and substantially centrally to the horizontal axis of the skate. The braking assembly consists of a means to transfer the force of a toe curl towards the heel, sliding brake pads into the wheels, slowing the skater via friction.

Figure 3:
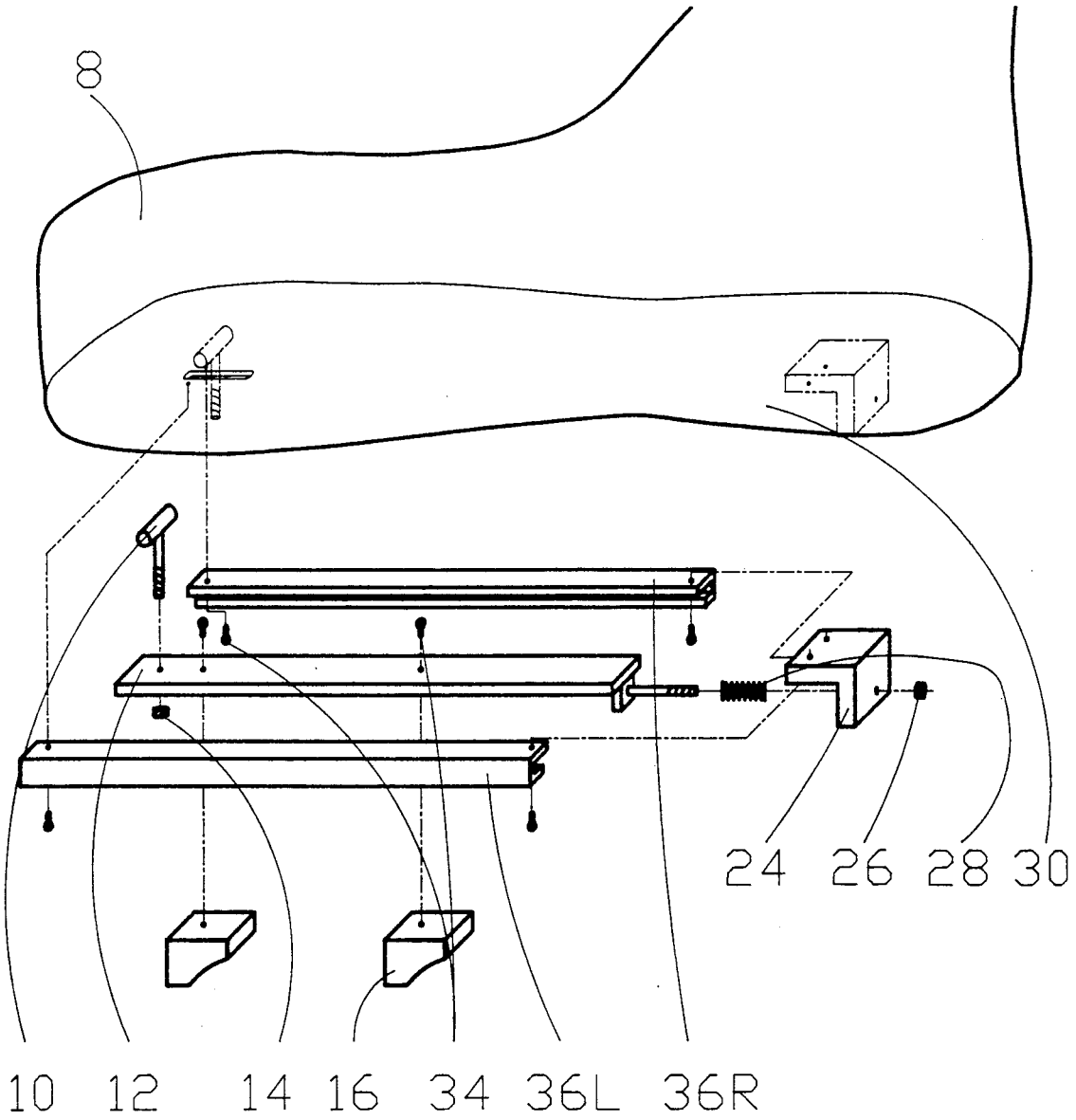

In FIG. 3, the slide bar 12 is made of a uniform, rigid, lightweight metal such as aluminum that is able to freely slide (towards the heel and toe) in the slide bar guides 36L and 36R. Near the front end of the slide bar 12 is a threaded hole (with other optional position holes) for the toe actuator 10 which protrudes into the skate boot 8 through the elongated hole 30. The slide bar 12 has sufficient forward length to always cover the elongated hole 30 regardless of the toe actuator 10 position. This protects the inside of the skate boot from rain and unwanted debris.

In FIG. 3, near the back of the slide bar 12 is permanently mounted (i.e. welded) a threaded protrusion pointed directly to the heel of the skate boot 8. The slide bar 12 protrusion freely slides through the horizontal hole in the slide bar mount 24 and has a slide bar nut 26 attached outside the slide bar mount 24. A coil spring 28 fits over the slide bar 12 protrusion but cannot pass through the hole in the slide bar mount 24. The slide bar mount 24 is attached to the bottom of the foot support platform and the spring provides the force to keep the brakes not engaged (FIG. 1) and is compressed via the toe actuator 10 when engaged (FIG. 2). The slide bar nut 26 provides adjustability forward and backward for the brake pads 16 and the toe actuator 10.

The brake pads 16 are mounted to the bottom side of the slide bar 12 via screws 34 and extend downward in sliding relation adjacent wheel. The spacing of the brake pads 16 is such to allow equal engagement on the wheels 18 and typically is the center to center distance between the wheels 18.

The material of the slide bar mount 24 is rigid and lightweight (such as plastic or wood) to retain the screws 34 and attached to the bottom of the skate. The width of the slide bar mount is narrow enough to fit between the two wheel holding frames 20 and has the proper spacing off the sole of the skate to support the slide bar guides 36L & 36R, allowing proper brake pad 16 engagement with the wheels.

The brake pads 16 are made of a molded material conforming to the outside of the wheels and replaceable via a screw mount 34. Synthetic materials such as plastic, rubber, epoxy and urethane that can offer frictional resistance to the wheels, handle the heat of friction, and maintain conformal contact with the wheels, will work.

The toe actuator 10 is ergonomically shaped to comfortably fit into the metacarpal arch of the toes of the average foot. The material must be strong enough to handle the sliding and torsional forces from the curling of the toes and encompass a threaded shaft that extends downward through the hole 30 in sole of the skate. A moldable epoxy can be used for the ergonomic top of the toe actuator 10. The toe actuator 10 is threaded into the slide bar 12 and locked in place by the toe actuator nut 14 that provides the vertical position adjustability of the toe actuator 10 inside the skate boot. Thus the toe actuator 10 remains tucked into the metacarpal arch of the toes comfortably without affecting normal skating.

In FIG. 3, the slide bar guides 36L & 36R have a slot running their entire length to allow the free sliding of the slide bar 12. A rigid and lightweight material such as extruded aluminum can be used. The slide bar guides 36L & 36R are mounted under the foot platform and run substantially along the length of the said platform. The slide bar guides position the slide bar 12 directly over the wheels 18 without impacting the free rotation of the wheels. The mounting screws 34 are recessed such as not to restrict the sliding bar 12 nor extend uncomfortably into the skate boot.

Additional embodiments can include utilizing a brake pad 16 for each wheel or any number less than the total number of wheels. Another embodiment could be applying the braking assembly to traditional side by side wheeled roller skates with a modification to the shape of the brake pads.

From the description above, a number of advantages of my invention become evident.

(a) A braking assembly, whereby, the simple curling of the toes imparts a controlled braking force on the skate wheels allowing safe easy skater stopping.

(b) The braking assembly will provide more controllable stopping regardless of the surfaces being skated upon (i.e. gravel, pavement, grass, etc.).

(c) The braking assembly is very ergonomically integrated into the skate, without affecting aesthetic appeal.

(d) The braking assembly can be applied to both skates allowing safer slowdowns on hills as well as turning at speed in either direction via individual brake application.

(e) The braking assembly can be retrofitted to current or old skate designs.

(f) The braking assembly provides complete brake position adjustability for personal skating and braking preferences, as well as maintaining easy wheel and brake pad replaceability.

OPERATION OF INVENTION

The manner for engaging the braking assembly is very different than most of the current braking techniques. The skater, via the simple intentional act of curling his/her toes, can transfer braking forces to the wheels sufficient to slow the skater down and come to a complete safe stop on hills or any surface being skated upon. The amount of braking is controlled by how hard the toes are curled and does not require any unnatural tipping of skates and also is independent of the type of surface being skated upon. The brakes are spring loaded and return to the not engaged position shown in FIG. 1 when the toes relax to their normal position. The toe actuator 10 is comfortably positioned in the skate boot so as not to impede any normal skating functions and has sufficient "play" to absorb slight toe curling and thereby preclude accidental brake application. The toe actuator 10 transfers a force towards the heel via the slide bar 12 to which the brake pads 16 are attached on the underside adjacent to the wheels 18. The brake pads 16 under the braking force slide towards the heel and engage the wheels 18 for frictional slowdown.

In FIG. 3 the toe actuator 10 is positioned into the metacarpal arch of the toes of the skater. It is suggested that the dealer/seller first adjust the position of the brakes at the time of the sale for a comfortable fit. The skater can also do his/her own adjustments and replacements. The vertical position of the toe actuator 10 is positioned by the distance it is threaded into the slide bar 12 and the toe actuator nut 14. The horizontal position is adjusted by the slide bar nut 26, thus offering complete adjustability to satisfy a variety of personal comfort and functional preferences. In FIG. 3, near the toe end of the slide bar 12, there are optional position holes for the toe actuator 10 to provide even more adjustability and positioning.

When stopping is to occur, the skater curls his/her toes sliding the toe actuator 10 backwards, which moves the slide bar 12 towards the heel of the skate and compresses coil spring 28 against the slide bar mount 24 (See FIG. 2). The brake pads 16 are attached to the underside of the slide bar 12 and engage with the wheels 18, causing frictional forces to slow the skater. The strength of the toe curl is sufficient to slow the skater in a more controlled and balanced manner.

When stopping is complete, the uncurling of the toes into their normal relaxed position, allows the coil spring 28 to extend and disengage the brake pads 16 from the wheels 18 as shown in FIG. 1. The normal position of the toe actuator 10 shown in FIG. 1, fits comfortably into the metacarpal arch of the toes without impeding any normal skating actions. This also provides sufficient space between the brake pads 16 and the wheels 18 that slight curling of the toes in normal skating will have sufficient clearance to prevent unintentional brake engagement.

Replacement of the brake pads 16 can occur at the time the wheels are replaced. The brake pad material is such that through wear it will remain conformal to the wheel surfaces. Once the wheels are removed the slide bar 12 can be slid out from under the skate by removing the slide bar nut 26, toe actuator 10, and the toe actuator nut 14. The brake pads are held via screws to the back of the slide bar 12.

SUMMARY, RAMIFICATIONS AND SCOPE

Accordingly, the reader will see that the braking assembly of the invention provides a safer, easily usable, lightweight braking for roller skates to be used by persons of any age or skill levels. Furthermore the braking assembly has the additional advantages in that it allows skaters with skill levels ranging from novice to expert to safely slowdown and stop without agile movements of skates and body weight.

it provides a superior braking assembly independent of skating surfaces such as gravel and pavement.

it provides an ergonomic design that can be integrated into new skates as well as retrofitted into old designs.

it offers complete adjustability for skater comfort and ease of use as well as replaceability for wear.

it can be applied to both skates offering better controlled slowdowns on hills while maintaining continuous wheel contact with the skating surface for safer skating balance.

it can offer speed turning in either direction via individual brake application and may evolve a new sport similar to figure skating without the need for ice.

While my above description contains many specificities, these should not be construed as limitations on the scope of the invention, but rather as an exemplification of one preferred embodiment thereof. Many other variations are possible. For example, a brake pad could be used for every wheel of the skate or for any lessor number depending upon the desired braking preferred. Many variations of brake pad materials and shapes are possible to attain different levels of braking. Additionally, this braking assembly can be applied to traditional side by side wheeled roller skates with a slight modification in the shape of the brake pad.

Accordingly, the scope of the invention should be determined not by the embodiment illustrated, but by the appended claims and their legal equivalents.

I claim:

1. A roller skate with a boot having an integrated braking structure comprising:

a toe actuator in said skate boot having a means to allow movement of said toe actuator, and a brake assembly and at least one brake pad, attached to said toe actuator and said roller skate for coupling braking energy to a plurality of wheels rotatably attached to said roller skate and means interconnected with the brake assembly for normally holding said brake assembly forward of said wheels in a nonbraking position, and means for controllably coupling a toe movement of a user with said toe actuator through said brake assembly to said at least one brake pad, whereby more safely braking said roller skate wheels.

2. The roller skate of claim 1 wherein the position of the toe actuator is tucked into the metacarpal arch of the foot behind the toes.

3. The roller skate of claim 1 wherein the brake assembly comprises a slide bar extending externally under said boot sliding freely lengthwise and supported by a set of slide bar guides with at least on brake pad attached to said slide bar and extending downward in sliding relation adjacent to said wheel.

4. The roller skate of claim 1 wherein the means holding said brake assembly forward of said wheels in nonbraking position is a resilient compressible means.

5. The roller skate of claim 1 wherein the toe actuator has adjustable means for positioning both vertically and horizontally.

6. A roller skate having a plurality of wheels arranged along the length of a foot support platform comprising in combination:

a set of spaced wheel holding frames projecting downwardly substantially at right angles from said platform and attached thereto to form rigid structure therewith;

a wheel and axle projecting through an aperture in said wheel holding frames;

means to secure each axle between said wheel holding frames with each wheel free running therebetween;

a boot attached to said foot support platform having a heel and toe;

a slide bar extending externally under said foot support platform sliding freely lengthwise and supported by a set of slide bar guides coupled to said foot support platform;

at least one brake pad attached to said slide bar and extending downward in sliding relation adjacent to said wheel;

a toe actuator secured to the front of said slide bar and extending upward through an elongated aperture in said foot platform, positioned near the toes of a user, engaged by a toe curling movement to force said slide bar and said brake pads towards the heel, thereby engaging with the surface of said wheels in a braking function;

and an interconnected compressible means for normally holding said slide bar and said brake pads forward of said wheels in a nonbraking position.

7. The roller skate of claim 6 wherein the brake pads are made of a synthetic urethane material.

8. The roller skate of claim 6 wherein the resilient compressible means is a coiled spring.

9. The roller skate of claim 6 wherein the slide bar contains multiple position holes for the toe actuator and the brake pads to provide for adjustability.

10. The roller skate of claim 6 wherein the brake pad shape substantially contacts only sides of the wheel that are not directly interfacing with a skating surface.

11. The roller skate of claim 6 wherein the position of the toe actuator is tucked into the metacarpal arch of the foot of a user and has adjustable means for positioning both horizontally and vertically.

* * * * *